US006719074B2

(12) United States Patent
Tsuda et al.

(10) Patent No.: US 6,719,074 B2
(45) Date of Patent: Apr. 13, 2004

(54) INSERT CHIP OF OIL-DRILLING TRICONE BIT, MANUFACTURING METHOD THEREOF AND OIL-DRILLING TRICONE BIT

(75) Inventors: Keiichi Tsuda, Itami (JP); Nobuyuki Mori, Itami (JP); Hideki Moriguchi, Itami (JP)

(73) Assignees: Japan National Oil Corporation, Tokyo (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/105,012

(22) Filed: Mar. 20, 2002

(65) Prior Publication Data

US 2003/0051924 A1 Mar. 20, 2003

(30) Foreign Application Priority Data

Mar. 23, 2001 (JP) ..... 2001-085675
Feb. 6, 2002 (JP) ..... 2002-029466

(51) Int. Cl.[7] ..... E21B 10/52
(52) U.S. Cl. ..... 175/428
(58) Field of Search ..... 175/426–435, 175/374

(56) References Cited

U.S. PATENT DOCUMENTS 4,694,918 A * 9/1987 Hall ..... 175/430
5,370,195 A 12/1994 Keshavan et al.
5,413,869 A 5/1995 Hartzell et al.
6,220,375 B1 * 4/2001 Butcher et al. ..... 175/428

FOREIGN PATENT DOCUMENTS

| | | |
|---|---|---|
| JP | 5-209488 | 8/1993 |
| JP | 7-150878 | 6/1995 |
| JP | 08-170482 | 7/1996 |
| JP | 10-511432 | 11/1998 |
| JP | 11-012090 | 1/1999 |
| WO | WO96/20056 | 7/1996 |

* cited by examiner

*Primary Examiner*—David Bagnell
*Assistant Examiner*—Matthew J Smith
(74) *Attorney, Agent, or Firm*—W. F. Fasse; W. G. Fasse

(57) ABSTRACT

An insert chip of an oil-drilling tricone bit includes an insert-chip substrate made of a cemented carbide of a first composition, and further includes a cemented carbide coating layer constituted of at least two stacked coating layers made of a cemented carbide of a composition different from the first composition. The cemented carbide coating layer covers the whole of a cutting edge of the insert-chip substrate. The coating layers each have a thickness, at a tip portion of the cutting edge, in a range from 0.1 mm to 2.5 mm, and the total thickness of the cemented carbide coating layer is in a range from 1 mm to 5 mm. The coating layers include an outermost cemented carbide layer and at least one intermediate coating layer in addition to the outermost cemented carbide layer, and the outermost cemented carbide layer has a hardness higher than that of the at least one intermediate coating layer and of the insert-chip substrate.

22 Claims, 6 Drawing Sheets

INSERT CHIP OF OIL-DRILLING TRICONE BIT, MANUFACTURING METHOD THEREOF AND OIL-DRILLING TRICONE BIT

BACKGROUND OF THE INVENTION

1. Field of the Invention

The present invention relates to insert chips and a manufacturing method thereof. Insert chips are used as blades (teeth) of a tricone bit which is a tool for drilling an oil well (hereinafter referred to as oil-drilling tricone bit). Specifically, the insert chips refer to, for example, an inner chip for drilling a well in the vertical direction and a gage pad for drilling the well in the radial direction of the well. The present invention further relates to an oil-drilling tricone bit having the insert chips as described above.

2. Description of the Background Art

A tool called a tricone bit is used for drilling an oil well for example. The tricone bit is used for drilling subterranean rocks and thus the tricone bit generally has, as its cutting edges, insert chips made of WC—Co-based cemented carbide with good abrasion resistance.

Insert chips for the tricone bit are generally classified into two types, i.e., an inner chip for vertical drilling of an oil well and a gage pad for drilling the oil well in the radial direction. An inner chip and a gage pad are schematically shown in FIGS. 9 and 10 respectively.

In recent years, oil wells are drilled at increasingly greater depths and accordingly rocks themselves at such great depths are hard to drill. Because of this, insert chips that are cutting edges of the tricone bit wear at earlier stages or some fragments of insert chips are broken (chipped) off from the insert chips (chipping of insert chips). A resultant problem is a shortened lifetime of the tricone bit. Moreover, a considerably costly work is necessary for lifting the tricone bit which reaches the end of its lifetime at several thousand meters below ground and for replacing the tricone bit with new one in order to proceed with drilling. Then, there is a need for further increase in the lifetime of insert chips.

Under the situation as described above, both of abrasion resistance and resistance to chipping (hereinafter chipping resistance) of insert chips must be improved. In general, cemented carbide has a higher hardness when it contains a smaller amount of Co and thus has an improved abrasion resistance, while the smaller amount of Co results in a higher brittleness of the cemented carbide which deteriorates the chipping resistance. In other words, the abrasion resistance and chipping resistance are not compatible with each other Various arts have been well known that concern the need for increase in the lifetime of insert chips as detailed below.

Japanese Patent Laying-Open No. 5-209488 discloses a rock-drilling button having an η (eta)-phase core exposed at the top and a surface region having a high Co content that is formed to enclose the η-phase core, produced by adjusting sintering conditions of cemented carbide. According to the art disclosed, abrasion is alleviated since the exposed η-phase touches rocks from the start of drilling. On the other hand, the high Co content in the surface region enhances the chipping resistance. A problem with this art is that the cemented carbide composition containing the η-phase which is an embrittlement phase is requisite. In general, the η-phase included in the cemented carbide could be an origin from which the metal is likely to chip off, resulting in deterioration of reliability.

Japanese Patent Laying-Open No. 7-150878 discloses an art of improving peeling resistance of the outermost polycrystalline diamond layer of an insert. This insert has a substrate made of sintered tungsten carbide, the outermost surface of a cutting edge of the insert is covered with the polycrystalline diamond layer, and an intermediate layer is provided between the substrate of sintered tungsten carbide and the polycrystalline diamond layer. The intermediate layer is a composite-material layer made of sintered tungsten carbide and polycrystalline diamond. However, a problem with this art is that the polycrystalline diamond itself has a low toughness which causes any crack in the outermost polycrystalline diamond layer and consequently the crack becomes an origin from which the insert breaks off.

Japanese Patent Laying-Open No. 11-12090 discloses a similar art according to which CVD (chemical vapor deposition) is used for coating a surface of a drill bit made of cemented carbide with diamond. However, the diamond and cemented carbide are different in thermal expansion coefficient which could cause a problem of peeling.

Japanese Patent Laying-Open No. 8-170482 proposes a drill bit having a hardness gradient. Specifically, the lowest hardness of a substrate of an insert chip of the drill bit increases gradually toward the leading end of the insert chip. It is noted that the tricone bit includes cone sections in which respective insert chips are fit and a body holding the cone sections, and not only the cone sections rotate but also the body itself rotates for drilling. Accordingly, not only tips of cutting edges of the insert chips but also sides of the cutting edges contribute to drilling. If the art disclosed in Japanese Patent Laying-Open No. 8-170482 is applied to insert chips of a tricone bit, the cutting edge has its side where cemented carbide of low hardness, i.e., low abrasion resistance, is exposed, since the insert chip is formed of a stack including cemented carbide materials of different compositions bonded to each other. A resultant problem is that the side of the cutting edge predominantly wears to shorten the lifetime.

Japanese National Patent Publication No. 10-511432 proposes an insert chip having a substrate of a cemented carbide and a cutting edge coated with one coating layer of a cemented carbide different from that of the substrate. Specifically, the coating layer of the cemented carbide has a lower Co content than that of the substrate for improving the abrasion resistance of the insert chip and satisfying the chipping resistance requirement by the substrate. It is known that decrease of Co content of cemented carbide decreases thermal expansion coefficient thereof. Then, if the difference in Co content between the substrate and the coating layer with which the substrate is coated is excessively large, a resultant problem is that the coating cemented carbide layer is peeled off or any crack occurs, for example. Then, according to this art, the coating cemented carbide layer cannot have its Co content greatly different from that of the substrate and thus the improvement of abrasion resistance is limited.

As discussed above, various studies have been conducted on insert chips for drilling and drill bits. However, there is still a need for an insert chip, especially an insert chip of an oil-drilling tricone bit, that is suitable for drilling rocks which are at greater depths and accordingly difficult to drill and that has both of abrasion resistance and chipping resistance.

SUMMARY OF THE INVENTION

One object of the present invention is to provide an insert chip of an oil-drilling tricone bit and a method of manufacturing the insert chip, the insert chip having both of abrasion resistance and chipping resistance. It is also an object of the present invention to provide an oil-drilling tricone bit suitable for drilling rocks which are at greater depths and thus hard to drill.

An insert chip of an oil-drilling tricone bit according to the present invention includes, in order to achieve the above-described objects, an insert-chip substrate made of a cemented carbide of a first composition, the substrate including a cylindrical body and a cutting edge for drilling, and includes a cemented carbide coating layer formed of at least two stacked coating layers made of a cemented carbide of a composition different from the first composition, the cemented carbide coating layer covering at least 80% of the surface area of the cutting edge of the insert-chip substrate. The coating layers each have a thickness, at a tip portion of the cutting edge, ranging from 0.1 mm to 2.5 mm and, the total thickness of the cemented carbide coating layer ranges from 1 mm to 5 mm. The coating layers include an outermost cemented carbide layer and at least one coating layer besides the outermost cemented carbide layer and the outermost cemented carbide layer has a hardness higher than that of that at least one coating layer and of the insert-chip substrate. By the above-described structure, it is possible to achieve a high abrasion resistance by the outermost cemented carbide coating layer and improve the chipping resistance by other coating layer(s) and the insert-chip substrate. Moreover, intermediate layer(s) lessens thermal stress, which accordingly prevents peeling and crack of the coating layers.

Preferably, the cemented carbide coating layer covers the whole of the cutting edge. Thus, the abrasion resistance can further be improved.

Preferably, those at least two stacked coating layers include, besides the outermost cemented carbide layer, an anti-chipping layer of a composition with a higher Co content than that of the outermost cemented carbide layer or with a larger WC particle size than that of the outermost cemented carbide layer. More preferably, the anti-chipping layer has a composition with a higher Co content than that of the insert-chip substrate. The chipping resistance can thus be improved. The anti-chipping layer which is one of the coating layers is accordingly thin, 2.5 mm or less in thickness. Therefore, resistance to plastic deformation is superior to the deformation resistance obtained by using a cemented carbide with a high Co content for the insert-chip substrate.

Preferably, the anti-chipping layer contains Co particles including special Co particles each elongated in the radial direction of the insert chip in a vertical cross sectional structure of the insert chip and each having a ratio ranging from 3 to 100 that is the length in the radial direction of the insert chip/the length in the axial direction of the insert chip, and the special Co particles constitute at least 5% by volume of the Co particles contained in the anti-chipping layer. Thus, it is possible to prevent any crack from opening and further running and accordingly improve the anti-chipping property.

Preferably, the outermost cemented carbide layer contains WC of an average particle size of at most 1 $\mu$m. Thus, it is possible to prevent WC particles from dropping off and accordingly increase the surface area of one WC particle, which improves adhesion between WC and Co.

Preferably, the outermost cemented carbide layer includes compressive residual stress. Thus, it is possible to prevent thermal crack and accordingly improve chipping resistance.

Preferably, the outermost cemented carbide layer includes compressive residual stress ranging from 0.05 GPa to 0.80 GPa. Thus, it is possible to prevent thermal crack from occurring without breakage of the layer itself.

Preferably, only the outermost cemented carbide layer among the coating layers contains diamond particles of a particle size ranging from 10 $\mu$m to 100 $\mu$m and the diamond particles constitute 5% to 40% by volume of the outermost cemented carbide layer. Thus, it is possible to enhance abrasion resistance relative to cemented carbide while diamond particles are unlikely to drop off.

Preferably, the diamond particles are each covered with at least one of refractory metal and ceramic of at most 1 $\mu$m in thickness. Thus, it is possible to improve the wetting property between the diamond particles and cemented carbide and accordingly improve the adhesion property therebetween.

Preferably, the outermost cemented carbide layer has a micro Vickers hardness of at least 15 GPa. Thus, it is possible to improve the abrasion resistance by the outermost cemented carbide layer with the chipping resistance maintained by those layers under the outermost layer.

An oil-drilling tricone bit according to the present invention includes, as its cutting edge, in order to achieve the above-described objects, any insert chip of an oil-drilling tricone bit as detailed above. By "insert chip of an oil-drilling tricone bit" provided as a cutting edge, the high abrasion resistance is achieved by the outermost cemented carbide layer and the chipping resistance is improved by remaining coating layer(s) and the insert-chip substrate. Then, the oil-drilling tricone bit has superior drilling performance for rocks at greater depths and thus hard to drill while having a long lifetime.

A method of manufacturing an insert chip of an oil-drilling tricone bit includes, in order to achieve the above-described objects, an inserting step of inserting an insert-chip substrate into a die, a stacking step of stacking, on the insert-chip substrate, cemented carbide powder to form a coating layer having a desired thickness after being sintered, and a sintering step of performing electrical pressure sintering, by using a punch inserted into the die, the punch having a depressed end which matches in shape a protruded cutting edge of the insert chip, applying a pressure ranging from 20 MPa to 50 MPa, and controlling the temperature of the punch within a temperature range from 1500° C. to 1800° C. By this method, it is possible to manufacture an insert chip of an oil-drilling tricone bit having its cemented carbide layer without gross porosity or cavity, without seepage of Co, and without mold breakage.

Preferably, in the sintering step, sintering is performed for a period ranging from 5 minutes to 20 minutes. By this method, it is possible to manufacture an insert chip of an oil-drilling tricone bit having denser cemented carbide without abnormal growth of WC particles.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 9:
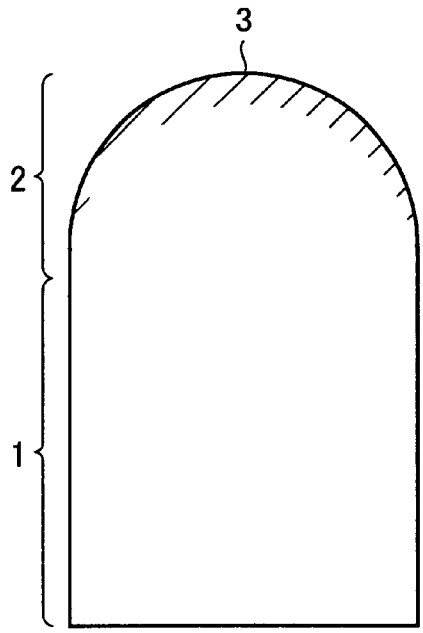
FIG. 9 PRIOR ART
FIG. 9 schematically shows a conventional inner chip.
Figure 10:
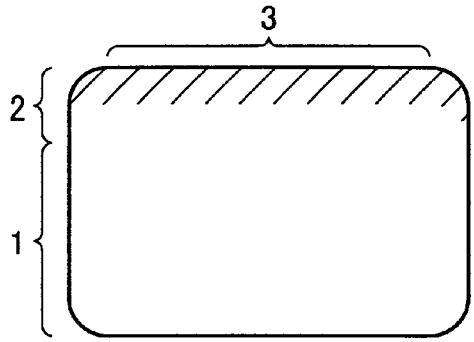
FIG. 10 PRIOR ART
FIG. 10 schematically shows a conventional gage pad.

As described above, insert chips for a tricone bit used for drilling an oil well (hereinafter simply referred to as "tricone bit") are classified roughly into two types, i.e., an inner chip for vertically drilling the well and a gage pad for drilling the well in the radial direction of the well. The inner chip (see FIG. 9) and the gage pad (see FIG. 10) are each constituted, in terms of components seen from the outside, generally of a cylindrical portion 1 fit in a body or cone of the tricone bit and a cutting edge 2 for drilling.

Figure 1:
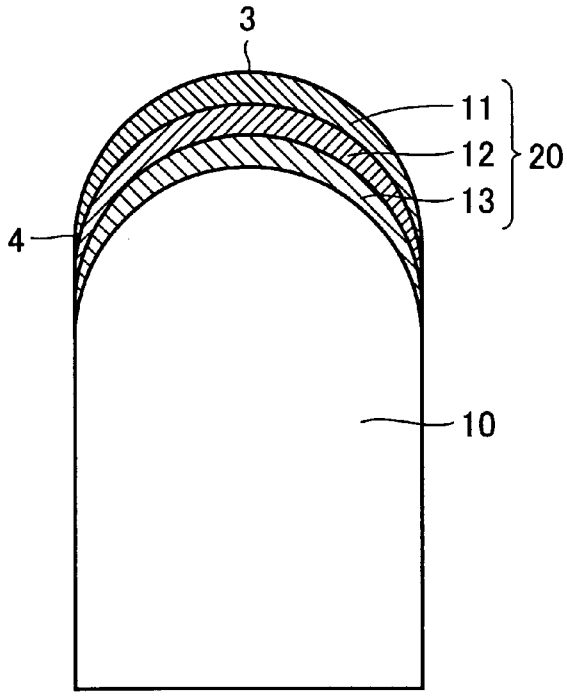
FIG. 1 shows a cross section of an inner chip as an example of insert chips according to a first embodiment of the present invention.
Figure 2:
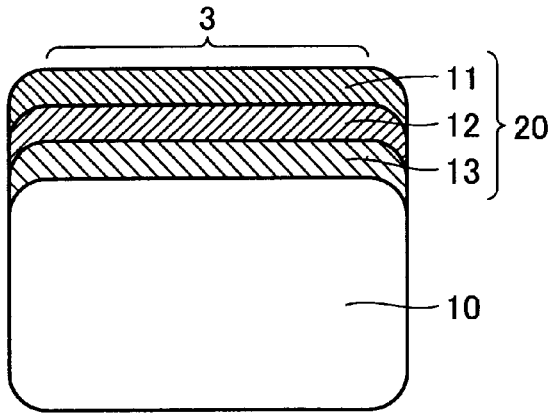
FIG. 2 shows a cross section of a gage pad as an example of insert chips according to the first embodiment of the present invention.

Exemplary insert chips according to a first embodiment of the present invention are shown in FIGS. 1 and 2, FIG. 1 showing an inner chip and FIG. 2 showing a gage pad. The inner chip and gage pad each include an insert-chip substrate 10 made of a cemented carbide of a first composition and a cemented carbide coating layer 20 constituted of at least two stacked coating layers 11, 12 and 13 respectively made of a cemented carbide of a respective composition different from the first composition of insert-chip substrate 10. Cemented carbide coating layer 20 is formed to entirely cover a cutting edge 2 of insert-chip substrate 10. Coating layers 11, 12 and 13 of the insert chip each have a thickness at a tip portion 3 of cutting edge 2 that ranges from 0.1 mm to 2.5 mm. The entire thickness of cemented carbide coating layer 20 ranges from 1 mm to 5 mm. The outermost coating layer 11 among coating layers 11, 12 and 13 (the outermost coating layer is hereinafter referred to as the "outermost cemented carbide layer") is made of a material having the highest hardness in comparison with the hardness of all of the other coating layers and the insert-chip substrate.

According to the first embodiment, the insert chip has cemented carbide coating layers 11, 12 and 13 that cover not only tip portion 3 of cutting edge 2 but also the whole of cutting edge 2. This is because, during a drilling operation of the tricone bit, cone sections with insert chips being fit therein of the tricone bit rotate, and accordingly both of tip portion 3 and a side portion 4 of cutting edge 2 contribute to drilling. In consideration of practical use, preferably at least 80% of the surface area of cutting edge 2 is covered with the coating layers. In particular, preferably the whole of cutting edge 2 is covered.

The composition of coating layer 11 which is the outermost cemented carbide layer has a low Co content relative to that of insert-chip substrate 10 in order to keep abrasion resistance. If insert-chip substrate 10 is directly covered with coating layer 11, there is a great difference in thermal expansion coefficient between substrate 10 and coating layer 11 and this difference causes a thermal stress possibly resulting in a problem that coating layer 11 is peeled off or any crack occurs. In order to avoid this problem, cemented carbide coating layers 12 and 13 having respective Co contents different from each other are provided as intermediate layers between coating layer 11 and substrate 10. Respective Co contents of coating layers 11, 12 and 13 are made different from each other to just small degrees so as to lessen the thermal stress. Although there are two intermediate layers provided between substrate 10 and the outermost cemented carbide layer according to this embodiment, the number of intermediate layers is not limited to two, and one layer or three or more layers may be provided as intermediate layers.

However, the total thickness of cemented carbide coating layers 11, 12 and 13 that is 1 mm or less does not provide the advantage of abrasion resistance while the total thickness of 5 mm or more deteriorates chipping resistance and thus is not preferred. If each coating layer made of a cemented carbide is less than 0.1 mm in thickness, the outermost cemented carbide layer has a deteriorated abrasion resistance and the intermediate layers do not serve to sufficiently lessen the thermal stress. On the other hand, if the thickness of each coating layer exceeds 2.5 mm, the outermost layer has a deteriorated chipping resistance. Then, preferably, the thickness of each coating layer ranges from 0.1 mm to 2.5 mm.

The above-described structure makes it possible for the outermost cemented carbide layer to have a micro Vickers hardness of 15 GPa. It has been known that a cemented carbide having a micro Vickers hardness of at least 15 GPa exhibits an excellent abrasion resistance with respect to rocks that are hard to drill (hard-to-drill rocks). However, the cemented carbide of at least 15 GPa has a relatively low chipping resistance. For this reason, practical use of such a cemented carbide for drilling of hard-to-drill rocks has been difficult. On the other hand, according to this embodiment, only the outermost thin cemented carbide layer of the insert chip has the micro Vickers hardness of at least 15 GPa, so that the abrasion resistance is kept by this cemented carbide layer while the lack of chipping resistance thereof is compensated for by underlying layers and the substrate of the insert chip. Then, the insert chip excellent in abrasion resistance with respect to hard-to-drill rocks, especially granite, is achieved.

Second Embodiment

An insert chip according to a second embodiment of the present invention is described now. In order to increase the rate of penetration (the distance the tricone bit penetrates or drills any rock formation per unit time), the chipping resistance of insert chips must be enhanced. Then, for enhancement of the chipping resistance, the insert chip of the present invention may have its substrate 10 of a cemented carbide composition with a high Co content. However, plastic deformation of this insert chip could occur due to geothermal heat or the like.

According to the second embodiment of the present invention, the insert chip includes a plurality of cemented carbide coating layers and, at least one, except for the outermost cemented carbide layer, of the coating layers has a higher Co content than that of an insert-chip substrate 10 (the higher-Co-content layer is hereinafter referred to as "anti-chipping layer"). This insert chip has its appearance as shown in FIGS. 1 and 2. Then, the anti-chipping layer is any of coating layer 12 and coating layer 13. Regarding details of the structure except for those described above, the second embodiment is the same as the first embodiment as described above.

The above-described structure includes at least one of coating layers that has a higher Co content than that of insert-chip substrate 10, i.e., anti-chipping layer, and the presence of this anti-chipping layer improves the chipping resistance. In this case, only one anti-chipping layer among cemented carbide coating layers may have a higher Co content. The maximum total thickness of the coating layers is merely 2.5 mm. Therefore, that one anti-chipping layer, which is a cemented carbide layer having a high Co content, among such thin coating layers, occupies a relatively small part of the entire structure. Accordingly, a higher resistance is achieved to the plastic deformation as compared with the structure having insert-chip substrate 10 made of a cemented carbide with a high Co content.

Third Embodiment

An insert chip according to a third embodiment of the present invention is described. The insert chip has its appearance as shown in FIGS. 1 and 2. The insert chip of the third embodiment is basically the same in structure as that of the second embodiment. One difference is that an anti-chipping layer includes flat Co particles elongated in the radial direction of the insert chip. Whether or not any Co particle has its shape corresponding to "flat Co particle elongated in the radial direction of the insert chip" is determined according to whether the Co particle has an aspect ratio ranging from 3 to 100 in the vertical cross-sectional constitution of the insert chip. Here, the aspect ratio of the Co particle refers to a ratio between the length in the radial direction of the insert chip and the length in the axial direction of the insert chip. Any Co particle corresponding to "flat Co particle elongated in the radial direction of the insert chip" is hereinafter referred to as "special Co particle." According to the third embodiment, the anti-chipping layer is made of a material which includes special Co particles of at least 5% by volume relative to the entire volume of Co particles of the material.

According to the third embodiment, the material of the anti-chipping layer includes at least 5% by volume of special Co particles relative to the entire volume of Co particles in the material. Then, as compared with any material including the same percentage by volume of spherical Co particles as that of special Co particles, the extent to which cracks run can be reduced which considerably improves the chipping resistance. Cracks in the insert chip tend to run in the axial direction of the insert chip. It is accordingly important that special Co particles are present as being elongated radially in the vertical cross-sectional constitution of the insert chip so that the special Co particles are each relatively short in the axial direction of the insert chip. The effect as described above is fully exhibited when the aspect ratio of Co particles ranges from 3 to 100. There is no significant difference in terms of this effect between the anti-chipping layer including Co particles of the aspect ratio of less than 3 and the anti-chipping layer having spherical Co particles. On the other hand, the aspect ratio exceeding 100 lowers the resistance to cracks.

Fourth Embodiment

An insert chip according to a fourth embodiment of the present invention is described. The insert chip has its appearance as shown in FIGS. 1 and 2. The insert chip of the fourth embodiment is basically the same in structure as that of the third embodiment. One difference is that the outermost cemented carbide layer, according to the fourth embodiment, is made of a cemented carbide material with an average WC particle size of 1 $\mu$m or less.

In some cases, insert chips used for drilling hard-to-drill rocks wear due to the fact that WC particles in the cemented carbide drop off therefrom. Then, WC particles are effectively reduced in size as small as possible to increase the surface area of one WC particle and thus enhance the adhesion between WC particles and Co. More specifically, the outermost cemented carbide layer is preferably made of a cemented carbide having WC particles with their average particle size of 1 $\mu$m or less. In this way, the insert chip is made remarkably effective for drilling of hard-to-drill rocks. According to the fourth embodiment, the outermost cemented carbide layer having an average WC particle size of at most 1 $\mu$m enables the insert chip to effectively drill rocks even if the rocks are hard to drill.

Fifth Embodiment

An insert chip according to a fifth embodiment of the present invention is described. The insert chip has its appearance as shown in FIGS. 1 and 2. The insert chip of the fifth embodiment is basically the same in structure as that described according to the first to fourth embodiments. One difference is that the outermost cemented carbide layer has a compressive residual stress ranging from 0.05 GPa to 0.80 GPa.

The presence of compressive residual stress on WC particles in the outermost cemented carbide layer, which is one of coating layers made of cemented carbide is considerably effective in improving the chipping resistance of the insert chip, since the presence of compressive residual stress effectively prevents thermal checks or cracks from appearing. However, the compressive residual stress of less than 0.05 GPa on WC particles does not provide such an advantage while the compressive residual stress exceeding 0.80 GPa is excessively high which results in breakage of particles themselves. The range of residual stress of the fifth embodiment is thus preferable.

Sixth Embodiment

An insert chip according to a sixth embodiment of the present invention is described. The insert chip has its appearance as shown in FIGS. 1 and 2. The insert chip of the sixth embodiment is basically the same in structure as that described according to the first to fifth embodiments. One difference is that only the outermost cemented carbide layer, among cemented carbide coating layers, contains diamond particles. The size of diamond particles ranges from 10 $\mu$m to 100 $\mu$m and, percentage by volume of the diamond particles relative to the volume of the outermost cemented carbide layer ranges from 5% by volume to 40% by volume.

The above-described structure including diamond particles in the outermost cemented carbide layer remarkably enhances the abrasion resistance. Here, if the particle size of diamond particles is less than 10 $\mu$m, the abrasion resistance achieved by the inclusion of diamond particles is not significantly different from that achieved without diamond particles in the outermost cemented carbide layer. On the other hand, if the diamond particle size exceeds 100 $\mu$m, diamond particles have a reduced surface area which contacts cemented carbide per a volume of a diamond particle and consequently diamond particles are likely to drop off. Then, no satisfactory abrasion resistance is exhibited. Further, the abrasion resistance achieved by less than 5% by volume of diamond particles is not significantly different from the abrasion resistance achieved by cemented carbide only. More than 40% by volume of diamond particles considerably deteriorates the chipping resistance. The structure according to the sixth embodiment is thus preferable Seventh Embodiment An insert chip according to a seventh embodiment of the present invention is described. The insert chip has its appearance as shown in FIGS. 1 and 2. The insert chip of the seventh embodiment is basically the same in structure as that described according to the sixth embodiment. One difference is that diamond particles included in the outermost cemented carbide layer are coated with a refractory metal or ceramic of 1 μm or less in thickness.

Coating of diamond particles with refractory metal or ceramic is especially effective in improvement of the wetting property of diamond particles with respect to cemented carbide. The insert chip according to the seventh embodiment has diamond particles coated with the refractory metal or ceramic of at most 1 μm in thickness, which increases the degree of adhesion between diamond particles and cemented carbide. This is preferable since diamond particles are unlikely to drop off.

Eighth Embodiment

A method of manufacturing an insert chip according to an eighth embodiment of the present invention is now described. This manufacturing method is applicable to manufacture of the insert chips as discussed in connection with the embodiments above. Although description here is applied to an inner chip, the description is also applicable to a gage pad.

Figure 3:
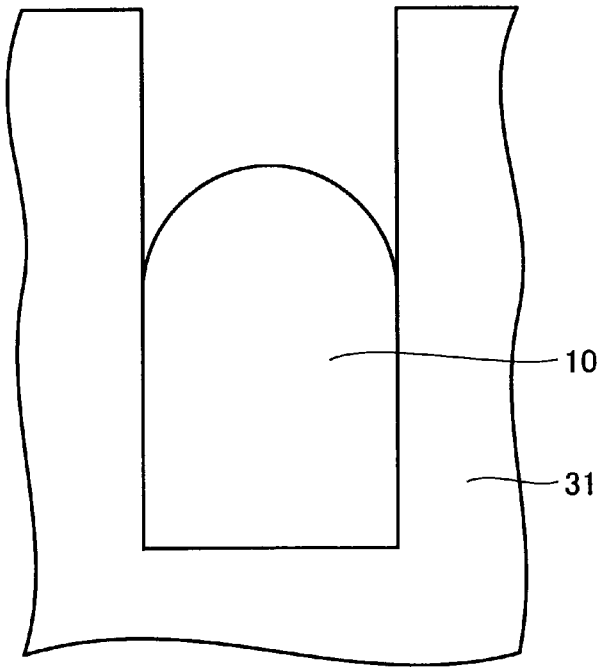
FIGS. 3–5 illustrate first to third steps in a process of manufacturing an insert chip according to an eighth embodiment of the present invention.
Figure 4:
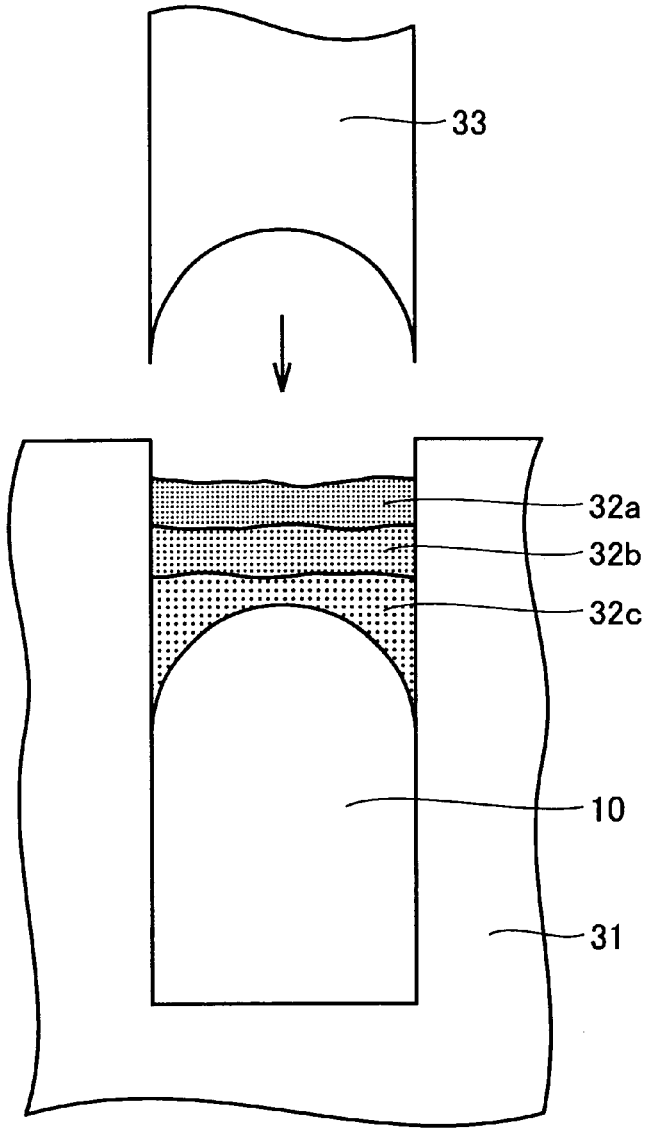
Figure 5:
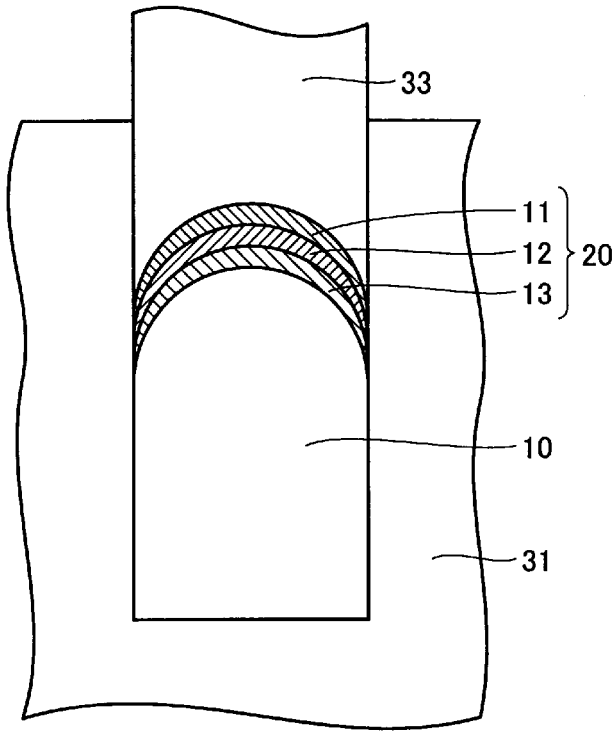

Referring to FIG. 3, an insert-chip substrate 10 is put in a sintering graphite die 31. Referring to FIG. 4, powder 32*a*, powder 32*b* and powder 32*c* of respective cemented carbide compositions are stacked on insert-chip substrate 10 to constitute respective coating layers having predetermined thicknesses respectively after being sintered. Then, as shown in FIG. 5, a graphite punch 33 is inserted, the punch having its depressed top matching the protruded cutting edge of the insert chip. By electrical pressure sintering with the applied pressure ranging from 20 MPa to 50 MPa and with the temperature of graphite punch 33 controlled so that the temperature ranges from 1500° C. to 1800° C., the insert chip as described in connection with each embodiment is produced.

According to this manufacturing method, if the applied pressure is lower than 20 MPa, the pressure is insufficient resulting in any gross porosity or cavity in the cemented carbide layers. If the pressure is higher than 50 MPa, the graphite die could be broken. Then, the applied pressure preferably ranges from 20 MPa to 50 MPa.

If the sintering temperature is lower than 1500° C., sintering of cemented carbide is impossible. On the other hand, the sintering temperature exceeding 1800° C. causes a problem that Co as a component of the cemented carbide seeps through and appears on the surface of the cemented carbide Therefore, the sintering temperature preferably ranges from 1500° C. to 1800° C.

Manufacturing under the conditions according to this embodiment is thus desirable.

The sintering time is desirably 5 to 20 minutes. If the sintering time is shorter than 5 minutes, dense cemented carbide cannot be produced. On the other hand, if the sintering time is longer than 20 minutes, an abnormal grain growth could occur of WC particles included in the cemented carbide which is not preferable.

Insert chips according to the above-discussed embodiments were actually manufactured and some experiments were conducted thereon. Experimental results are hereinafter described in connection with "Examples."

EXAMPLE 1

Figure 6:
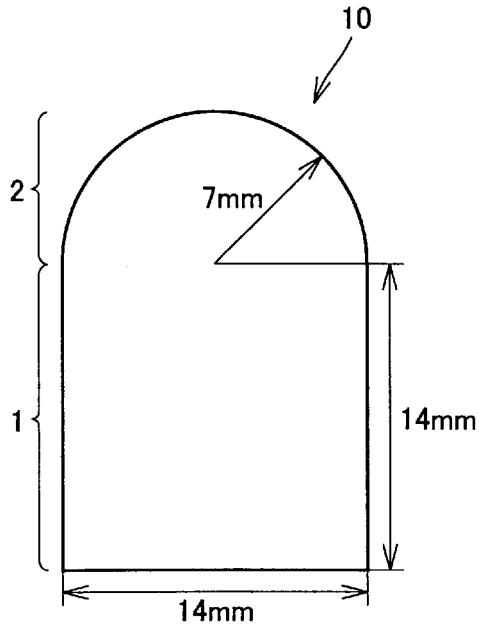
FIG. 6 is a side view of an insert-chip substrate which is used according to the first embodiment.
Figure 7:
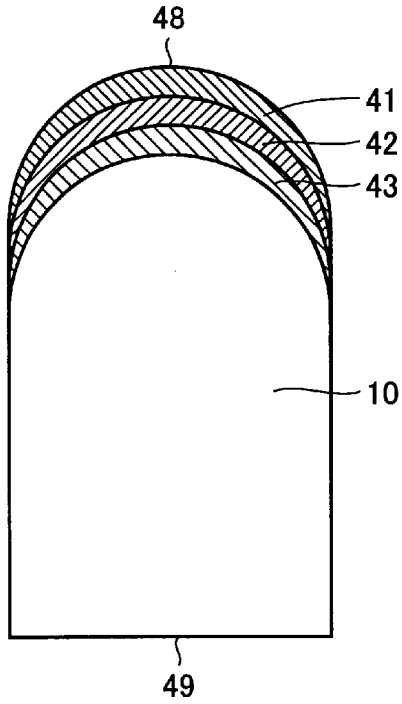
FIG. 7 shows a cross section of a sample used for Example 1.

An insert-chip substrate 10 for a tricone bit as shown in FIG. 6 was prepared. Although the description here is applied to an inner chip, the description is also applicable to a gage pad. Insert-chip substrate 10 was made of a cemented carbide having a composition of WC-20% Co and the WC particle size was 4 μm. Powder layers were stacked on a cutting edge 2 of insert-chip substrate 10 to constitute a first layer 41, a second layer 42 and a third layer 43. Samples B–J were then produced through electrical pressure sintering. The samples had a cross section as shown in FIG. 7. It is noted that the first, second and third layers are named in the order from the one closest to the outermost surface to the one closest to the inside of insert-chip substrate 10.

For each of samples B–J, two samples for tool evaluation and two samples for alloy-characteristic evaluation were prepared. Composition of stacked cemented carbides, thickness and hardness of each layer, and sintering conditions are shown in Table 1 and Table 2.

TABLE 1

COMPOSITION ETC. OF EXAMPLE 1 SAMPLES

| Sample | Composition of 1st cemented carbide layer (average WC particle size) | Composition of 2nd cemented carbide layer (average WC particle size) | Composition of 3rd cemented carbide layer (average WC particle size) | Applied pressure (MPa) | Sintering temperature of upper punch (° C.) |
|---|---|---|---|---|---|
| *A | no 1st layer | no 2nd layer | no 3rd layer | — | — |
| *B | WC (2 μm)-10% Co | no 2nd layer | no 3rd layer | 40 | 1700 |
| C | WC (2 μm)-10% Co | WC (2 μm)-15% Co | no 3rd layer | 40 | 1700 |
| D | WC (2 μm)-10% Co | WC (2 μm)-15% Co | no 3rd layer | 22 | 1780 |
| E | WC (1 μm)-10% Co | WC (2 μm)-15% Co | no 3rd layer | 48 | 1520 |
| *F | WC (2 μm)-10% Co | WC (2 μm)-15% Co | no 3rd layer | 40 | 1700 |
| *G | WC (2 μm)-10% Co | WC (2 μm)-15% Co | no 3rd layer | 40 | 1700 |
| H | WC (2 μm)-5% Co | WC (2 μm)-15% Co | no 3rd layer | 40 | 1400 |
| I | WC (2 μm)-10% Co | WC (2 μm)-15% Co | WC (4 μm)-22% Co | 25 | 1600 |
| J | WC (0.7 μm)-10% Co | WC (2 μm)-15% Co | no 3rd layer | 30 | 1500 |

*Samples not in accordance with the present invention

TABLE 2

COATING-LAYER THICKNESS ETC. OF EXAMPLE 1 SAMPLES

| Sample | Thickness of 1st layer (mm) | Thickness of 2nd layer (mm) | Thickness of 3rd layer (mm) | Hardness of 1st layer (GPa) | Hardness of 2nd layer (GPa) | Hardness of 3rd layer (GPa) |
|---|---|---|---|---|---|---|
| *A | 0 | 0 | 0 | — | — | — |
| *B | 5 | 0 | 0 | 14.5 | — | — |
| C | 2.5 | 2.5 | 0 | 14.7 | 13.5 | — |
| D | 0.5 | 0.5 | 0 | 14.6 | 13.4 | — |
| E | 1 | 1 | 0 | 16.5 | 13.5 | — |
| *F | 0.3 | 0.3 | 0 | 14.3 | 13.6 | — |
| *G | 3 | 3 | 0 | 14.5 | 13.6 | — |
| H | 0.1 | 1 | 0 | 18.3 | 13.4 | — |
| I | 1 | 1 | 1 | 14.6 | 13.5 | 7.5 |
| J | 1 | 1 | 0 | 18.5 | 13.8 | — |

*Samples not in accordance with the present invention

The samples for evaluation of alloy characteristics were each cut along the central axis thereof and the resultant cross sections were mirror-finished. On the central axis of the mirror-finished cross section, the thickness of stacked cemented carbide layers each, i.e., the thickness of each coating layer, was measured by means of an optical microscope. Further, at five points on the central axis of the cross section, the hardness of stacked coating layers each was measured with a micro Vickers hardness meter, and the average hardness was employed as the hardness of each coating layer.

It is noted that sample A was insert-chip substrate 10 itself without coating layer that was used for comparison.

The samples for tool evaluation were press-fit into the leading end of a rock drill, used to drill a hole in granite. An impact test was performed for 5 hours under the conditions that the impact energy was 30 J/shot and the number of shots was 2000/min. After the test, for each sample, the amount of wear in the longitudinal direction of the sample as well as whether any breakage or crack was present or not were checked.

Results of this test are shown in Table 3.

TABLE 3

DRILL TEST RESULTS OF SAMPLES A–J

| Sample | Wear amount (mm) | Damage etc. to sample after test |
|---|---|---|
| *A | 5.8 | normal wear |
| *B | 4.9 | 1st layer peeled in 2 hours |

TABLE 3-continued

DRILL TEST RESULTS OF SAMPLES A–J

| Sample | Wear amount (mm) | Damage etc. to sample after test |
|---|---|---|
| C | 1.2 | normal wear |
| D | 1.3 | normal wear |
| E | 1.1 | normal wear |
| *F | 4.5 | normal wear |
| *G | 4.2 | 1st layer peeled in 4 hours |
| H | 0.6 | normal wear |
| I | 1.3 | normal wear |
| J | 0.5 | normal wear |

*Samples not in accordance with the present invention

EXAMPLE 2

For Example 2, an insert-chip substrate 10 which is the same as that of Example 1 was prepared. Cemented carbide powder layers were stacked on a cutting edge 2 of insert-chip substrate 10 to form the first to third layers 41–43 and then samples K–R were produced by electrical pressure sintering. For each of samples K–R, two samples for tool evaluation and two samples for alloy-characteristic evaluation were produced. Each sample has its cross section as shown in FIG. 7. Table 4 and Table 5 show composition of stacked cemented carbides, thickness of each layer, volume percentage and aspect ratio of special Co particles (defined in the description of the third embodiment) in the third cemented carbide layer having its Co content higher than that of the insert-chip substrate.

TABLE 4

COMPOSITION ETC. OF EXAMPLE 2 SAMPLES

| Sample | Composition of 1st cemented carbide layer (average WC particle size) | Composition of 2nd cemented carbide layer (average WC particle size) | Composition of 3rd cemented carbide layer (average WC particle size) | Applied pressure (MPa) | Sintering temperature of upper punch (° C.) |
|---|---|---|---|---|---|
| *K | no 1st layer | no 2nd layer | no 3rd layer | — | — |
| *L | WC (2 μm)-10% Co | no 2nd layer | no 3rd layer | 40 | 1700 |
| M | WC (1 μm)-10% Co | WC (2 μm)-15% Co | no 3rd layer | 48 | 1520 |
| N | WC (2 μm)-10% Co | WC (2 μm)-15% Co | WC (4 μm)-22% Co | 25 | 1600 |
| O | WC (2 μm)-10% Co | WC (2 μm)-15% Co | WC (4 μm)-22% Co | 35 | 1600 |

TABLE 4-continued

COMPOSITION ETC. OF EXAMPLE 2 SAMPLES

| Sample | Composition of 1st cemented carbide layer (average WC particle size) | Composition of 2nd cemented carbide layer (average WC particle size) | Composition of 3rd cemented carbide layer (average WC particle size) | Applied pressure (MPa) | Sintering temperature of upper punch (° C.) |
|---|---|---|---|---|---|
| P | WC (2 μm)-10% Co | WC (2 μm)-15% Co | WC (4 μm)-22% Co | 40 | 1600 |
| Q | WC (2 μm)-10% Co | WC (2 μm)-15% Co | WC (4 μm)-22% Co | 45 | 1600 |
| R | WC (2 μm)-10% Co | WC (2 μm)-15% Co | WC (4 μm)-22% Co | 48 | 1600 |

*Samples not in accordance with the present invention

TABLE 5

COATING-LAYER THICKNESS ETC. OF EXAMPLE 2 SAMPLES

| Sample | Thickness of 1st layer (mm) | Thickness of 2nd layer (mm) | Thickness of 3rd layer (mm) | Flat Co ratio in 3rd layer (%) | Aspect ratio in 3rd layer |
|---|---|---|---|---|---|
| *K | 0 | 0 | 0 | — | — |
| *L | 5 | 0 | 0 | — | — |
| M | 1 | 1 | 0 | — | — |
| N | 1 | 1 | 1 | 2 | 6 |
| O | 1 | 1 | 1 | 48 | 20 |
| P | 1 | 1 | 1 | 55 | 80 |
| Q | 1 | 1 | 1 | 87 | 90 |
| R | 1 | 1 | 1 | 98 | 110 |

*samples not in accordance with the present invention

The samples for evaluation of alloy characteristics were each cut along the central axis thereof and the resultant cross sections were mirror-finished. On the central axis of the mirror-finished cross section, the thickness of stacked cemented carbide layers each, i.e., the thickness of each coating layer, was measured by means of an optical microscope. Further, on the central axis of the cross section, a×1500 photograph was taken of the constitution of the third layer having a higher Co content than that of the insert-chip substrate, the photograph being taken as an optical-photomicrograph of the structure (field of view: 60 μm×40 μm). By image processing, the volume ratio of special Co particles (volume ratio of special Co particles to the volume of all Co particles in the third coating layer) was determined. In addition, the aspect ratio of flat Co was determined on the optical-photomicrograph of the structure.

It is noted that sample K was insert-chip substrate 10 itself without coating layer that was used for comparison.

It was confirmed that the samples for tool evaluation each had a semispherical cutting edge with a radius of 7 mm. Then, an end portion 49 of each sample was partially cut away so as to make the height of the completed insert chip equal to the length of the original insert-chip substrate 10.

The samples for tool evaluation were each press-fit into the leading end of a rock drill, used to drill a hole in granite. An impact test was performed for 5 hours under the conditions that the impact energy was 50 J/shot and the number of shots was 2000/min. After the test, for each sample, the amount of wear in the longitudinal direction of the sample as well as whether any breakage or crack was present or not were checked.

Results of this test are shown in Table 6.

TABLE 6

DRILL TEST RESULTS OF SAMPLES K–R

| Sample | Wear amount (mm) | Damage etc. to sample after test |
|---|---|---|
| *K | unmeasurable | test stopped as considerably deformed in 1 hour |
| *L | unmeasurable | badly damaged in 0.5 hour |
| M | 2.8 | chipping |
| N | 2.2 | chipping |
| O | 2.1 | tiny cracks |
| P | 1.5 | normal wear |
| Q | 1.4 | normal wear |
| R | 2.1 | tiny cracks |

*samples not in accordance with the present invention

EXAMPLE 3

For Example 3, an insert-chip substrate 10 which is the same as that of Example 1 was prepared. Cemented carbide powder layers were stacked on a cutting edge 2 of substrate 10 to form the first to third layers 41–43 and then samples T–Y were produced by electrical pressure sintering. For each of samples T–Y, two samples for tool evaluation and two samples for alloy-characteristic evaluation were produced. Each sample has its cross section as shown in FIG. 7. Table 7 and Table 8 show composition of stacked cemented carbides, thickness of each layer, and compressive residual stress in the first layer which is the outermost cemented carbide layer.

TABLE 7

COMPOSITION ETC. OF EXAMPLE 3 SAMPLES

| Sample | Composition of 1st cemented carbide layer (average WC particle size) | Composition of 2nd cemented carbide layer (average WC particle size) | Composition of 3rd cemented carbide layer (average WC particle size) | Applied pressure (MPa) | Sintering temperature of upper punch (° C.) |
|---|---|---|---|---|---|
| *S | no 1st layer | no 2nd layer | no 3rd layer | — | — |
| *T | WC (2 μm)-10% Co | no 2nd layer | no 3rd layer | 40 | 1700 |
| U | WC (1 μm)-10% Co | WC (2 μm)-15% Co | no 3rd layer | 40 | 1700 |
| V | WC (1 μm)-10% Co | WC (2 μm)-15% Co | no 3rd layer | 40 | 1700 |
| W | WC (1 μm)-10% Co | WC (2 μm)-18% Co | no 3rd layer | 40 | 1700 |
| X | WC (1 μm)-5% Co | WC (2 μm)-15% Co | no 3rd layer | 40 | 1700 |
| Y | WC (1 μm)-5% Co | WC (2 μm)-15% Co | no 3rd layer | 40 | 1700 |

*Samples not in accordance with the present invention

TABLE 8

COATING-LAYER THICKNESS ETC. OF EXAMPLE 3 SAMPLES

| Sample | Thickness of 1st layer (mm) | Thickness of 2nd layer (mm) | Thickness of 3rd layer (mm) | Compression pressure in 1st layer (GPa) |
|---|---|---|---|---|
| *S | 0 | 0 | 0 | 0 |
| *T | 5 | 0 | 0 | 0 |
| U | 1 | 1 | 0 | 0.04 |
| V | 0.7 | 1 | 0 | 0.15 |
| W | 0.8 | 1 | 0 | 0.45 |
| X | 0.7 | 1 | 0 | 0.79 |
| Y | 0.6 | 1 | 0 | 0.85 |

*Samples not in accordance with the present invention

The samples for evaluation of alloy characteristics were each cut along the central axis thereof and the resultant cross sections were mirror-finished. On the central axis of the mirror-finished cross section, the thickness of stacked cemented carbide layers each, i.e., the thickness of each coating layer, was measured by means of an optical microscope. Further, the residual stress of WC particles was measured, at a tip portion 48 of the cutting edge of the insert chip, by a residual-stress-measuring method with X-ray sin2ϕ. The residual stress of WC was determined for WC face (212) by using a Young's modulus of 590 GPa and a Poisson ratio of 0.22.

It is noted that sample S was insert-chip substrate 10 itself without coating layer that was used for comparison.

It was confirmed that the samples for tool evaluation each had a semispherical cutting edge with a radius of 7 mm. Then, an end portion 49 of each sample was partially cut away so as to make the height of the completed insert chip equal to the length of the original insert-chip substrate 10. The samples for tool evaluation were each press-fit into the leading end of a rock drill, used to drill a hole in granite. An impact test was performed for 5 hours under the conditions that the impact energy was 40 J/shot and the number of shots was 2500/min. After the test, for each sample, the amount of wear in the longitudinal direction of the sample as well as whether any breakage or crack was present or not were checked.

Results of this test are shown in Table 9.

TABLE 9

DRILL TEST RESULTS OF SAMPLES S–Y

| Sample | Wear amount (mm) | Damage etc. to sample after test |
|---|---|---|
| *S | unmeasurable | test stopped as being considerably deformed in 2 hours |
| *T | unmeasurable | badly damaged in 1 hour |
| U | 3.3 | tiny cracks |
| V | 2.1 | normal wear |
| W | 2.2 | normal wear |
| X | 2.1 | normal wear |
| Y | 3.1 | tiny cracks |

*Samples not in accordance with the present invention

EXAMPLE 4

For Example 4, an insert-chip substrate 10 which is the same as that of Example 1 was prepared. Cemented carbide powder layers were stacked on a cutting edge 2 of substrate 10 to form the first to third layers 41–43 and then samples BB–LL were produced by electrical pressure sintering. The first layer 41 of samples DD–LL was formed of cemented carbide powder with which diamond particles were mixed. For each of samples BB–LL, two samples for tool evaluation and two samples for alloy-characteristic evaluation were produced. Each sample has its cross section as shown in FIG. 7. Table 10 and Table 11 show composition of stacked cemented carbides, size of diamond particles in the first layer 41, volume percentage of the diamond particles relative to the first layer 41, material with which diamond particles are coated, and composition of respective cemented carbides of the second and third layers. Table 12 shows thickness of each coating layer for example.

TABLE 10

COMPOSITION ETC. OF EXAMPLE 4 SAMPLES

| Sample | Composition of 1st layer | State of diamond in 1st layer: Particle size (μm) | vol % | Coating material | coating thickness (μm) |
|---|---|---|---|---|---|
| *AA | no 1st layer | — | — | — | — |
| *BB | cemented carbide | — | — | — | — |

TABLE 10-continued

COMPOSITION ETC. OF EXAMPLE 4 SAMPLES

| Sample | Composition of 1st layer | State of diamond in 1st layer: Particle size (μm) | vol % | Coating material | coating thickness (μm) |
|---|---|---|---|---|---|
| CC | cemented carbide | — | — | — | — |
| DD | cemented carbide + diamond | 11 | 29 | no coating | — |
| EF | cemented carbide + diamond | 98 | 6 | no coating | — |
| FF | cemented carbide + diamond | 50 | 20 | no coating | — |
| GG | cemented carbide + diamond | 50 | 20 | metal W | 0.5 |
| HH | cemented carbide + diamond | 50 | 20 | SiC | 0.7 |
| II | cemented carbide + diamond | 50 | 20 | SiC | 0.2 |
| JJ | cemented carbide + diamond | 70 | 20 | no coating | — |
| KK | cemented carbide + diamond | 5 | 25 | no coating | — |
| LL | cemented carbide + diamond | 120 | 2 | no coating | — |

*Samples not in accordance with the present invention

TABLE 11

2ND/3RD LAYER COMPOSITION ETC. OF EXAMPLE 4 SAMPLES

| Sample | Composition of 2nd cemented carbide layer (average WC particle size) | Composition of 3rd cemented carbide layer (average WC particle size) | Applied pressure (MPa) | Sintering temperature of upper punch (° C.) |
|---|---|---|---|---|
| *AA | no 2nd layer | no 3rd layer | — | — |
| *BB | no 2nd layer | no 3rd layer | 40 | 1700 |
| CC | WC (2 μm)-15% Co | no 3rd layer | 40 | 1650 |
| DD | WC (2 μm)-15% Co | no 3rd layer | 25 | 1600 |
| EE | WC (2 μm)-15% Co | no 3rd layer | 35 | 1550 |
| FF | WC (2 μm)-15% Co | no 3rd layer | 40 | 1700 |
| GG | WC (2 μm)-15% Co | no 3rd layer | 40 | 1700 |
| HH | WC (2 μm)-15% Co | no 3rd layer | 40 | 1700 |
| II | WC (2 μm)-25% Co | WC (2 μm)-15% Co | 40 | 1700 |
| JJ | WC (2 μm)-15% Co | no 3rd layer | 40 | 1700 |
| KK | WC (2 μm)-15% Co | no 3rd layer | 40 | 1700 |
| LL | WC (2 μm)-15% Co | no 3rd layer | 40 | 1700 |

*Samples not in accordance with the present invention

TABLE 12

COATING-LAYER THICKNESS ETC. OF EXAMPLE 4 SAMPLES

| Sample | Thickness of 1st layer (mm) | Thickness of 2nd layer (mm) | Thickness of 3rd layer (mm) | Hardness of 1st layer (GPa) | Compression stress in 1st layer (GPa) |
|---|---|---|---|---|---|
| *AA | 0 | 0 | no 3rd layer | — | 0 |
| *BB | 5 | 0 | no 3rd layer | 13.5 | 0 |
| CC | 1 | 1 | no 3rd layer | 13.5 | 0.04 |
| DD | 1 | 1 | no 3rd layer | 16.8 | 0.5 |
| EE | 1 | 1 | no 3rd layer | 17.2 | 0.7 |
| FF | 1 | 1 | no 3rd layer | 17 | 0.68 |
| GG | 1 | 1 | no 3rd layer | 17 | 0.45 |
| HH | 1 | 1 | no 3rd layer | 16.9 | 0.45 |
| II | 1 | 1 | 1 | 17.3 | 0.38 |
| JJ | 1 | 1 | no 3rd layer | 20 | 0.37 |
| KK | 1 | 1 | no 3rd layer | 22 | 0.37 |
| LL | 1 | 1 | no 3rd layer | 17 | 0.35 |

*Samples not in accordance with the present invention

The samples for evaluation of alloy characteristics were each cut along the central axis thereof and the resultant cross sections were mirror-finished. On the central axis of the mirror-finished cross section, the thickness of stacked cemented carbide layers each, i.e., the thickness of each coating layer, was measured by means of an optical microscope.

It is noted that sample AA was insert-chip substrate 10 itself without coating layer that was used for comparison.

It was confirmed that the samples for tool evaluation each had a semispherical cutting edge with a radius of 7 mm. Then, an end portion 49 of each sample was partially cut away so as to make the height of the completed insert chip equal to the length of the original insert-chip substrate 10. The samples for tool evaluation were each press-fit into the leading end of a rock drill, used to drill a hole in granite. An impact test was performed for 5 hours under the conditions that the impact energy was 25 J/shot and the number of shots was 2000/min. After the test, for each sample, the amount of wear in the longitudinal direction of the sample as well as whether any breakage or crack was present or not were checked.

Results of this test are shown in Table 13.

TABLE 13

DRILL TEST RESULTS OF SAMPLES AA–LL

| Sample | Wear amount (mm) | Damage etc. to sample after test |
|---|---|---|
| *AA | 6 | normal wear |
| *BB | 5.1 | 1st layer peeled in 2 hours |
| CC | 1.3 | normal wear |
| DD | 0.4 | normal wear |
| EE | 0.5 | normal wear |
| FF | 0.4 | normal wear |
| GG | 0.2 | normal wear |
| HH | 0.2 | normal wear |
| II | 0.2 | normal wear |
| JJ | 0.3 | normal wear |
| KK | 0.9 | normal wear |
| LL | 1.1 | normal wear |

*Samples not in accordance with the present invention

Ninth Embodiment

Figure 8:
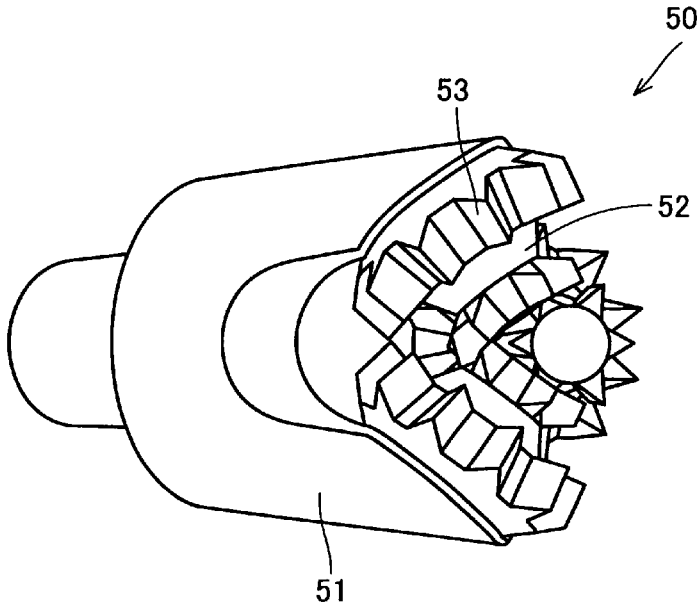
FIG. 8 schematically shows an oil-drilling tricone bit according to a ninth embodiment of the present invention.

Referring to FIG. 8, a structure of an oil-drilling tricone bit according to a ninth embodiment of the present invention is described. This oil-drilling tricone bit 50 has, as shown in FIG. 8, a plurality of rotatable cones 52 attached to an end portion of a body 51. Three cones 52 are usually attached to one body 51, and cones 52 are arranged with respective tops that are directed inward and face each other. A plurality of insert chips 53 serving as cutting edges respectively are each inserted from the outer surface of associated cone 52 and secured there. Insert chip 53 here is any of the insert chips described in connection with the first to seventh embodiments.

The structure of the oil-drilling tricone bit is illustrated in FIG. 8 by way of example only. The oil-drilling tricone bit intended by the present invention may be any, if the tricone bit has any of insert chips described in connection with the first to seventh embodiments. Thus, the shape, number and arrangement of cones as well as the shape of the body are not limited to those shown in FIG. 8.

Oil-drilling tricone chip 50 includes insert chips arranged respectively as cutting edges, and a high abrasion resistance is achieved by the outermost cemented carbide coating layers of the insert chips while an improved chipping resistance is achieved by other coating layers and the insert-chip substrate. It is thus possible for the oil-drilling tricone bit to exhibit a high performance in drilling of rocks that are at greater depths and thus hard to drill and still have a long lifetime.

According to the present invention, the insert chip includes the outermost cemented carbide layer which is one of cemented carbide coating layers each having an appropriate thickness at the tip portion of the cutting edge of the insert chip. The outermost cemented carbide layer has a higher hardness than that of other coating layers and the insert-chip substrate. Accordingly, it is possible to achieve a high abrasion resistance by the outermost cemented carbide layer and simultaneously achieve a high chipping resistance by other coating layers and the insert-chip substrate. Moreover, the thermal stress is reduced by intermediate layers, which prevents peeling and crack of coating layers. The oil-drilling tricone bit having such insert chips is thus appropriate for drilling of hard-to-drill rocks.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An insert chip of an oil-drilling tricone bit comprising:

a substrate that is made of a first cemented carbide of a first composition and that includes a cylindrical body and a cutting edge for drilling; and a plurality of coating layers successively stacked on said substrate and covering at least 80% of a total surface area of said cutting edge of said substrate;

wherein:

said plurality of coating layers includes an outermost coating layer that comprises a second cemented carbide of a second composition different from said first composition, that is located directly at and forms an exposed outermost surface of said insert chip, and that has a thickness in a range from 0.1 mm to 2.5 mm at a tip portion of said cutting edge;

said plurality of coating layers further comprises an intermediate coating layer that comprises a third cemented carbide of a third composition different from said first composition, that is disposed between said substrate and said outermost coating layer, and that has a thickness in a range from 0.1 mm to 2.5 mm at said tip portion of said cutting edge;

said plurality of coating layers has a total thickness in a range from 1 mm to 5 mm; and said outermost coating layer has a hardness greater than a hardness of said intermediate coating layer and greater than a hardness of said substrate.

2. The insert chip of an oil-drilling tricone bit according to claim 1, wherein said plurality of coating layers covers 100% of said total surface area of said cutting edge.

3. The insert chip of an oil-drilling tricone bit according to claim 1, wherein said intermediate coating layer is an anti-chipping layer, of which said third composition contains Co with a higher Co content than said second composition of said outermost coating layer, or contains WC particles with a larger WC particle size than said second composition of said outermost coating layer.

4. The insert chip of an oil-drilling tricone bit according to claim 1, wherein said intermediate coating layer is an anti-chipping layer of which said third composition contains Co with a higher Co content than said first composition of said substrate.

5. The insert chip of an oil-drilling tricone bit according to claim 4, wherein said anti-chipping layer contains Co particles including special Co particles each elongated in a radial direction of said insert chip in a vertical cross-sectional structure of said insert chip and each having a ratio of a length in the radial direction of said insert chip relative to a length in an axial direction of said insert chip being in a range from 3 to 100, and said special Co particles constitute at least 5% by volume of all of said Co particles contained in said anti-chipping layer.

6. The insert chip of an oil-drilling tricone bit according to claim 1, wherein said outermost coating layer contains WC particles having an average particle size of at most 1 $\mu$m.

7. The insert chip of an oil-drilling tricone bit according to claim 1, wherein said outermost coating layer has a compressive residual stress.

8. The insert chip of an oil-drilling tricone bit according to claim 7, wherein said compressive residual stress is in a range from 0.05 GPa to 0.80 GPa.

9. The insert chip of an oil-drilling tricone bit according to claim 1, wherein only said outermost coating layer among said plurality of coating layers further contains diamond particles embedded in said second cemented carbide, and said diamond particles have a particle size in a range from 10 μm to 100 μm and constitute 5% to 40% by volume of said outermost coating layer.

10. The insert chip of an oil-drilling tricone bit according to claim 9, further comprising at least one of a refractory metal and a ceramic covering each of said diamond particles as a covering layer of at most 1 μm in thickness.

11. The insert chip of an oil-drilling tricone bit according to claim 1, wherein said outermost coating layer has a micro Vickers hardness of at least 15 GPa.

12. An oil-drilling tricone bit having as its cutting edge the insert chip of an oil-drilling tricone bit according to claim 1.

13. The insert chip of an oil-drilling tricone bit according to claim 1, wherein said plurality of coating layers further includes another coating layer that comprises a fourth cemented carbide of a fourth composition different from said first composition, that is disposed between said substrate and said outermost coating layer, and that has a thickness in a range from 0.1 mm to 2.5 mm at said tip portion of said cutting edge.

14. The insert chip of an oil-drilling tricone bit according to claim 1, wherein said plurality of coating layers does not contain any diamond particles.

15. The insert chip of an oil-drilling tricone bit according to claim 1, wherein said second cemented carbide of said outermost coating layer comprises particles of a carbide bonded together by a bonding metal.

16. The insert chip of an oil-drilling tricone bit according to claim 15, wherein said carbide is tungsten carbide (WC) and said bonding metal is cobalt (Co).

17. The insert chip of an oil-drilling tricone bit according to claim 15, wherein said outermost coating layer consists of said particles of said carbide and said bonding metal.

18. A method of manufacturing the insert chip of an oil-drilling tricone bit according to claim 1, comprising the following steps:

an inserting step of inserting said substrate into a die;

a stacking step of stacking, on said substrate, cemented carbide powders to form said plurality of coating layers having said total thickness after being sintered; and a sintering step of performing electrical pressure sintering, by using a punch inserted into said die, said punch having a depressed end which matches in shape a desired finished protruded cutting edge of said insert chip, applying a pressure in a range from 20 MPa to 50 MPa, and controlling the temperature of said punch within a temperature range from 1500° C. to 1800° C.

19. The method of manufacturing an insert chip of an oil-drilling tricone bit according to claim 18, wherein in said sintering step, said sintering is performed for a period in a range from 5 minutes to 20 minutes.

20. An insert chip of an oil-drilling tricone bit comprising:

an insert-chip substrate made of a cemented carbide of a first composition, said substrate including a cylindrical body and a cutting edge for drilling; and a cemented carbide coating layer formed of at least two stacked coating layers made of a cemented carbide of a composition different from said first composition, said cemented carbide coating layer covering at least 80% of a surface area of said cutting edge of said insert-chip substrate; wherein said coating layers each have a thickness, at a tip portion of said cutting edge, in a range from 0.1 mm to 2.5 mm, and the total thickness of said cemented carbide coating layer is in a range from 1 mm to 5 mm, said coating layers include an outermost cemented carbide layer and at least one coating layer besides said outermost cemented carbide layer, and said outermost cemented carbide layer has a hardness higher than that of said at least one coating layer and of said insert-chip substrate, and said outermost cemented carbide layer contains WC particles of an average particle size of at most 1 μm.

21. An insert chip of an oil-drilling tricone bit comprising:

an insert-chip substrate made of a cemented carbide of a first composition, said substrate including a cylindrical body and a cutting edge for drilling; and a cemented carbide coating layer formed of at least two stacked coating layers made of a cemented carbide of a composition different from said first composition, said cemented carbide coating layer covering at least 80% of a surface area of said cutting edge of said insert-chip substrate; wherein said coating layers each have a thickness, at a tip portion of said cutting edge, in a range from 0.1 mm to 2.5 mm, and the total thickness of said cemented carbide coating layer is in a range from 1 mm to 5 mm, said coating layers include an outermost cemented carbide layer and at least one coating layer besides said outermost cemented carbide layer, and said outermost cemented carbide layer has a hardness higher than that of said at least one coating layer and of said insert-chip substrate, and only said outermost cemented carbide layer among said coating layers contains diamond particles of a particle size in a range from 10 μm to 100 μm and said diamond particles constitute 5% to 40% by volume of said outermost cemented carbide layer.

22. An insert chip of an oil-drilling tricone bit comprising:

an insert-chip substrate made of a cemented carbide of a first composition, said substrate including a cylindrical body and a cutting edge for drilling; and a cemented carbide coating layer formed of at least two stacked coating layers made of a cemented carbide of a composition different from said first composition, said cemented carbide coating layer covering at least 80% of a surface area of said cutting edge of said insert-chip substrate; wherein said coating layers each have a thickness, at a tip portion of said cutting edge, in a range from 0.1 mm to 2.5 mm, and the total thickness of said cemented carbide coating layer is in a range from 1 mm to 5 mm, said coating layers include an outermost cemented carbide layer and at least one coating layer besides said outermost cemented carbide layer, and said outermost cemented carbide layer has a hardness higher than that of said at least one coating layer and of said insert-chip substrate, and said outermost cemented carbide layer has a micro Vickers hardness of at least 15 GPa.

* * * * *